US008939516B2

(12) United States Patent
Myers et al.

(10) Patent No.: US 8,939,516 B2
(45) Date of Patent: Jan. 27, 2015

(54) ROTARY CUTTER DRUM FOR CONTINUOUS MINING MACHINE

(71) Applicant: Caterpillar Global Mining Highwall Miners LLC, Beckley, WV (US)

(72) Inventors: Stewart Myers, Beckley, WV (US); Robert Henry, Princeton, WV (US); Cornelis Wilhelm In't Hout, Dordrecht (NL)

(73) Assignee: Caterpillar Global Mining Highwall Miners LLC, Beckley, WV (US)

( * ) Notice: Subject to any disclaimer, the term of this patent is extended or adjusted under 35 U.S.C. 154(b) by 0 days.

(21) Appl. No.: 13/717,817

(22) Filed: Dec. 18, 2012

(65) Prior Publication Data

US 2014/0167487 A1 Jun. 19, 2014

(51) Int. Cl.
*E21C 27/24* (2006.01)
*E21C 25/10* (2006.01)

(52) U.S. Cl.
CPC ..... *E21C 25/10* (2013.01); *E21C 27/24* (2013.01)
USPC ..... 299/76; 299/78

(58) Field of Classification Search
CPC ..... E21C 31/06; E21C 25/08
USPC ..... 299/53, 76, 78, 81.2, 81.3; 384/291, 384/372
See application file for complete search history.

(56) References Cited

U.S. PATENT DOCUMENTS

| | | | | | |
|---|---|---|---|---|---|
| 2,471,187 | A * | 5/1949 | Atwater | 384/291 |
| 2,937,908 | A * | 5/1960 | Golten | 384/288 |
| 3,213,703 | A * | 10/1965 | Fitzgerald | 74/432 |
| 3,801,157 | A * | 4/1974 | Munger | 299/64 |
| 4,021,274 | A * | 5/1977 | Chadwick | 148/573 |
| 5,108,154 | A * | 4/1992 | Brandl et al. | 299/76 |
| 6,190,276 | B1 * | 2/2001 | Eisenbarth | 474/198 |
| 6,626,500 | B1 * | 9/2003 | Cribb et al. | 299/78 |
| 7,717,522 | B2 | 5/2010 | In'T Hout et al. | |
| 7,997,659 | B2 | 8/2011 | Oertley et al. | |
| 8,500,208 | B1 * | 8/2013 | Bentley | 299/76 |
| 2008/0197690 | A1 | 8/2008 | In T Hout | |
| 2012/0205964 | A1 | 8/2012 | In't Hout et al. | |

FOREIGN PATENT DOCUMENTS

| | | |
|---|---|---|
| GB | 781282 | * 8/1957 |
| GB | 2045837 | 11/1980 |
| GB | 2243857 | 4/1991 |

* cited by examiner

*Primary Examiner* — David Bagnell
*Assistant Examiner* — Michael Goodwin
(74) *Attorney, Agent, or Firm* — Foley & Lardner LLP

(57) ABSTRACT

A rotary cutter drum for a continuous mining machine having a cutter drum, a bearing hub, an inner bearing, a sealing assembly and a shaft disposed in an inner portion of the cutter drum, the shaft having at least one flat passageway disposed along a longitudinal axis of the hub for allowing a lubricating fluid to move from an oil reservoir to a bearing surface.

18 Claims, 7 Drawing Sheets

ROTARY CUTTER DRUM FOR CONTINUOUS MINING MACHINE

TECHNICAL FIELD

The disclosure relates to cutter drums for mining equipment. More specifically, the disclosure relates to rotary cutter drums for continuous mining machines, also known as continuous cutter modules and cutter modules.

BACKGROUND

Highwall mining is applied in harvesting coal, minerals, ores or other materials in seams or veins under an overburden, which may be accessed from an exposed edge of the seam or vein. Highwall mining is applicable where a continuous mining machine can be placed in a cut or trench to extend a cutter module, followed by a train of conveyor segments (or units) as the cutter module advances, into a substantially horizontal shaft under the overburden. Usually a train of segments for Highwall mining comprises a cutter module, a train of conveyor segments, provided with a conveyor for transporting mined material from and to opposite adjacent conveyor segments in the train of conveyor segments and a drive for the cutter module and conveyors. U.S. Pat. No. 7,717,522 describes a conveyor segment for use in a train of conveyor segments for Highwall mining.

The cutter drum is one of the most important wear items on a continuous mining machine. The cutter drum constitutes an important limit on the machine's excavation (sump) speed and efficiency. Improvements to cutter drum designs that make them last longer, allow them to apply greater forces to the seam drive (tunnel) face, and/or can improve the economics of excavating seam drives with a continuous mining machine.

In some circumstances, environmental conditions in the mining area near or at the cutter module can hamper efficient mining. For example, a very low (thin seam) mining shaft with ample shear-up and limited cutter-drum cutting space can decrease the mining capacity due to limited roller bearing capacities and cutting vibrations at the expense of mined material. In addition, such circumstances may also cause damage to parts of the mining equipment like cutter drives, x-pair tapered roller bearings, seals, gear boxes, and shear arms. U.S. Pat. No. 7,997,659 describes a rotary cutter for tunnel boring machine which can be used in low mining shaft applications.

SUMMARY

An embodiment of the present disclosure relates to a rotary cutter including a cutter drum having bore and a bit coupled to an exterior surface of the cutter drum. The rotary cutter also includes a shaft positioned inside the bore, the shaft having a flat passageway extending along a longitudinal axis of the shaft and a bearing portion disposed on an exterior surface of the shaft.

Another embodiment of the present disclosure relates to a rotary cutter having a cutter drum having a first bore, the bore having a first inner portion having a first diameter and a second inner portion having a second diameter wherein the second diameter is greater than the first diameter. The rotary cutter further includes a cutting bit coupled to the cutter drum, a bearing having a second bore, the bearing disposed in the first bore, and a shaft positioned inside the second bore, the shaft having a flat passageway extending along an axis of the shaft and a bearing portion disposed on an exterior surface of the shaft, the bearing portion being in contact with the bearing. In addition, the rotary cutter includes an oil reservoir disposed in the second inner portion between the cutter drum and the shaft, the oil reservoir being filled with a lubricating fluid, wherein the lubricating fluid passes along the passageway from the oil reservoir to a surface where the bearing portion of the shaft contacts the bearing.

Yet another embodiment of the present disclosure relates to a mining machine having a frame and a shaft coupled to the frame, the shaft having a flat passageway extending along an axis of the shaft and a bearing portion disposed on an exterior surface of the shaft. The mining machine further includes a bearing disposed on the shaft, a portion of the bearing being in contact with the bearing portion of the shaft and a cutter drum disposed on the bearing, the cutter drum rotating with respect to the shaft. The mining machine also includes a cutting bit coupled to the cutter drum.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
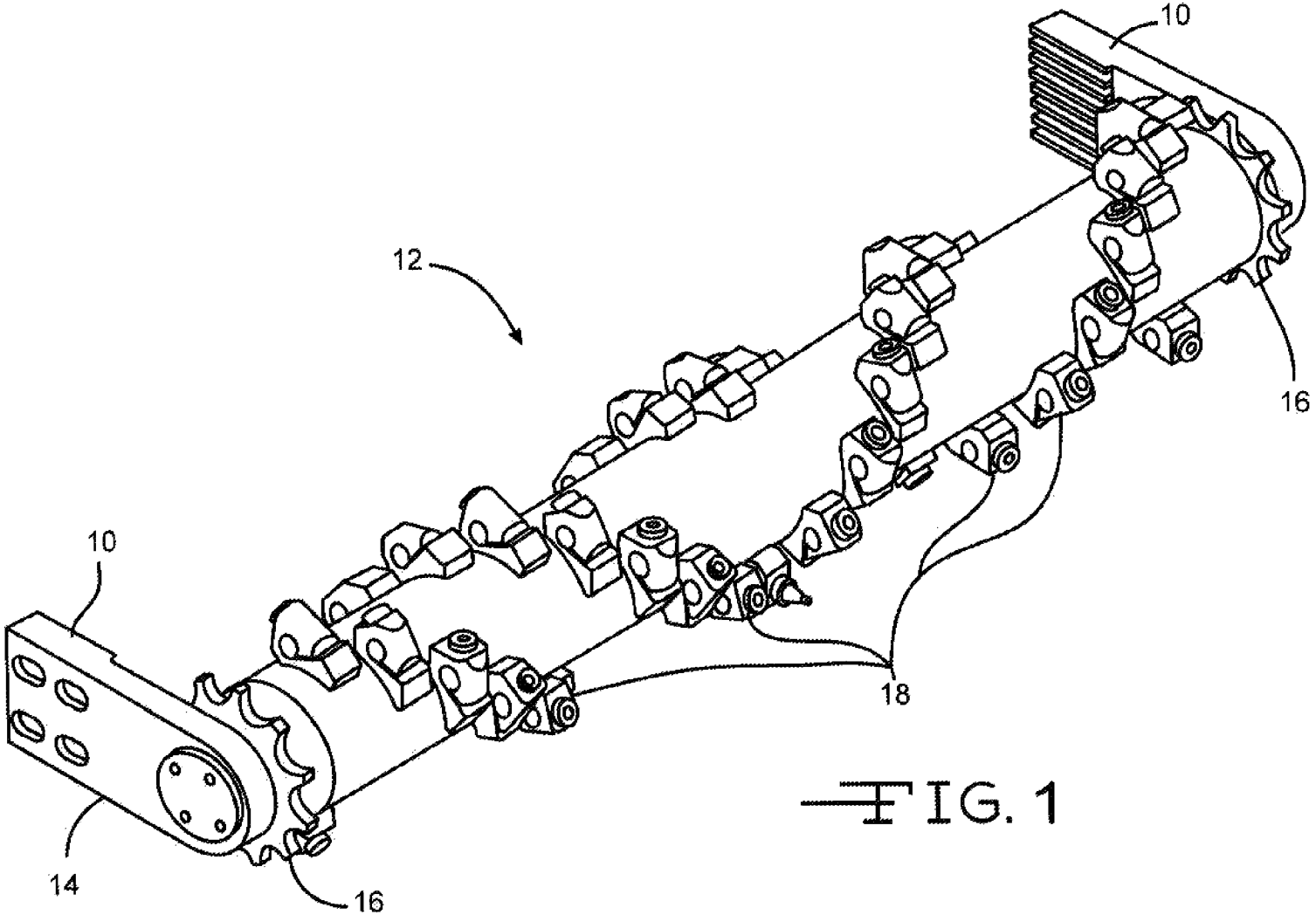
FIG. 1 is a perspective view of frame and a rotary cutter.

FIG. 1 is a perspective view of a frame 10 and a rotary cutter 12. The frame 10 and rotary cutter 12 are coupled to a cutter module frame which is coupled to a train of conveyer segments for use in a continuous mining machine.

Figure 2:
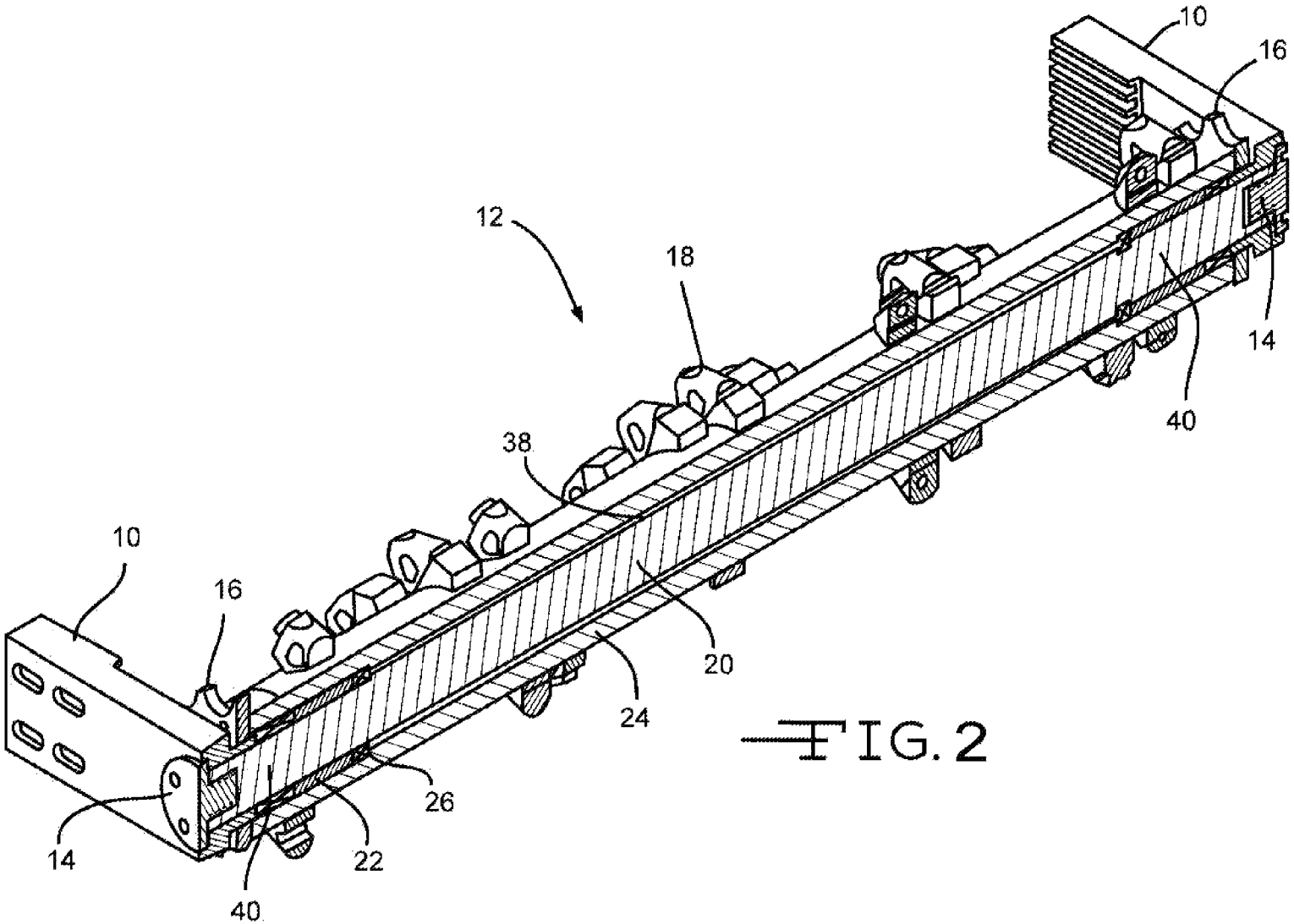
FIG. 2 is a perspective section view of the frame and the rotary cutter of FIG. 1.
Figure 3:
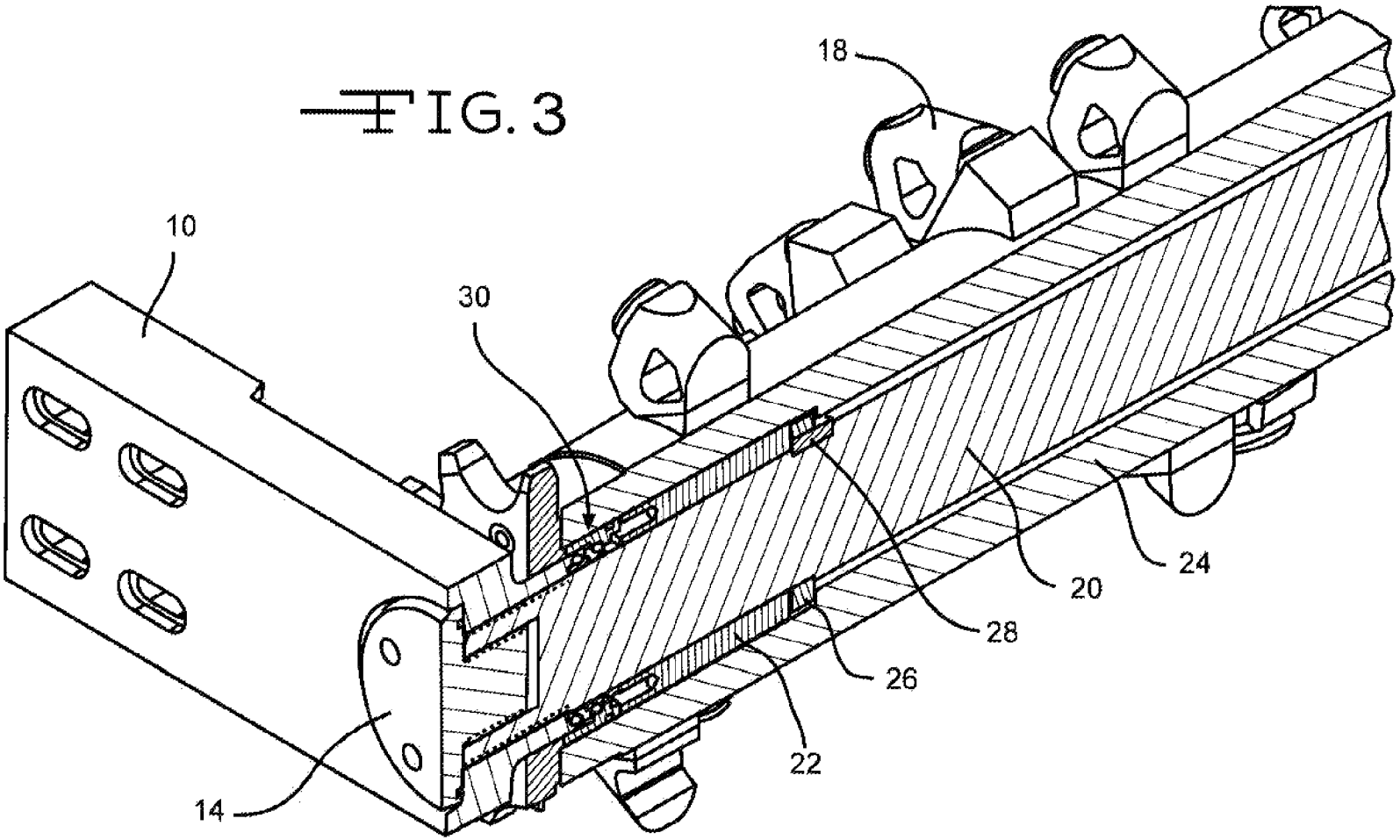
FIG. 3 is a detailed perspective section view of the frame and the rotary cutter of FIG. 1.

FIG. 2 is a perspective section view of the frame 10 and rotary cutter 12 and FIG. 3 is an enlarged perspective view of a portion of the frame 10 and rotary cutter 12. The rotary cutter 12 includes a shaft 20, two bearing hubs 22, a cutter drum 24, two inner bearings 26, two keys 28, and two seal assemblies 30. Two end caps 14 assist in coupling the rotary cutter 12 to the frame 10. In the illustrated embodiment two sprockets 16 are coupled to the rotary cutter 12. The sprockets 16 are turned by a chain, belt, or the like, thus causing the rotary cutter 12 to rotate. Pick bits 18 are coupled to the rotary cutter 12. The pick bits 18 are relatively sharp, circumferential cutting pick bits that contact a mineral and/or rock face for crushing, excavating and/or removing material from a mining site.

Figure 7:
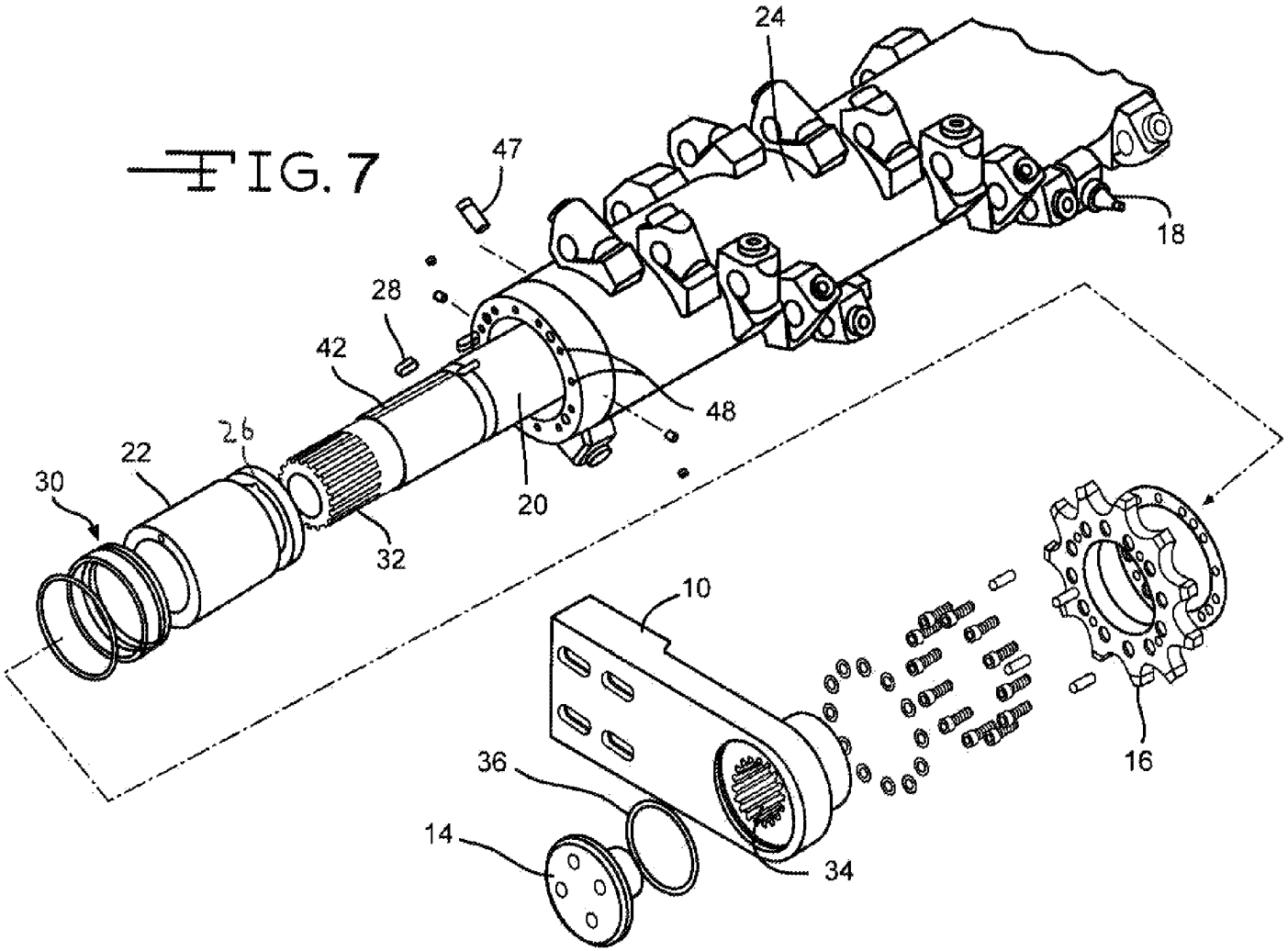
FIG. 7 is an exploded view of the frame and the rotary cutter of FIG. 1.
Figure 8:
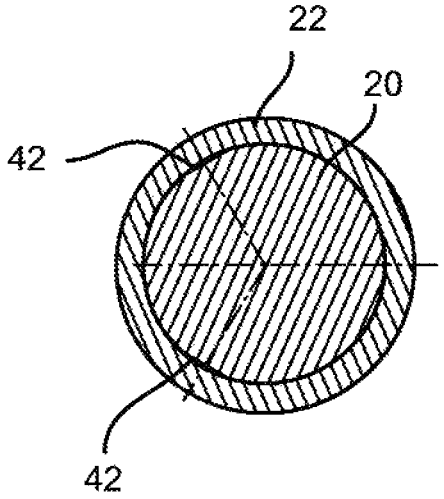
FIG. 8 is a side section view of the shaft and bearing hub of FIG. 5.

The shaft 20 is substantially cylindrical in shape and is sized and configured to have a portion of the shaft 20 fit inside of the cutter drum 24. The shaft 20 is crowned such that the diameter of the shaft 20 at the center 38 of the shaft 20 is slightly larger than the diameter of the ends 40 of the shaft 20. When the shaft 20 bows under forces that will be thrust on the cutter drum 24 during cutting operations, the end 40 of the shaft 20 nearest the applied force will remain approximately flat along the portions of the shaft 20 that are in contact with the bearing hubs 22, which results in more even loading of the bearing hubs 22 which allows for greater forces to be placed on the cutter drum 24. Four longitudinal passageways 42 are disposed on the shaft 20 (shown in FIG. 7 and FIG. 8), two passageways 42 each being disposed near each end 40 of the shaft 20. The passageways 42 are substantially flat and may be laser hardened or induction hardened. As can be seen in FIG. 8 the passageways 42 are oriented to the opposite of force directions (the force directions being the directions that the rotary cutter 12 moves to cut into an area to be mined) to optimize bearing and lube film areas. Referring to FIG. 8, the rotary cutter 12 cuts into an area to be mined in at least one of the 3 O'clock direction, the 12 O'clock direction (up) and the 6 O'clock direction (down); the passageways 42 are approximately located at 7 O'clock and 11 O'clock. In an alternative embodiment the longitudinal passageways 42 extend along an entire longitudinal length, from one end 40 to the other end 40, of the shaft 20. Both ends 40 of the shaft 20 include splines 32 (best seen in FIG. 7) disposed thereon. Corresponding slots 34 are cut into portions of the frame 10 in order to assist in coupling the shaft 20 to the frame 10 and to inhibit rotation of the shaft 20 with respect to the frame 10. A hollow portion 35 is disposed on the ends 40 of the shaft 20, the hollow portion 35 being sized and configured to allow a portion of the end cap 14 to be disposed inside the hollow portion 35. A seal 36 may be disposed between the end cap 14 and the frame 10 to inhibit foreign materials, such as dirt, grit or the like, from coming into contact with the shaft 20.

The shaft 20 is coupled to the frame 10 using a combination of the end caps 14, the splines 32 and the slots 34 such that forces from the cutter drum 24 are transferred to the bearing hub 22, and then to the shaft 20, and then in turn to the frame 10. The mounting of each end of the rotary cutter 12 to the frame 10 minimizes the deflection of the rotary cutter 12 under a given load as compared to a cantilever mounting arrangement.

Figure 4:
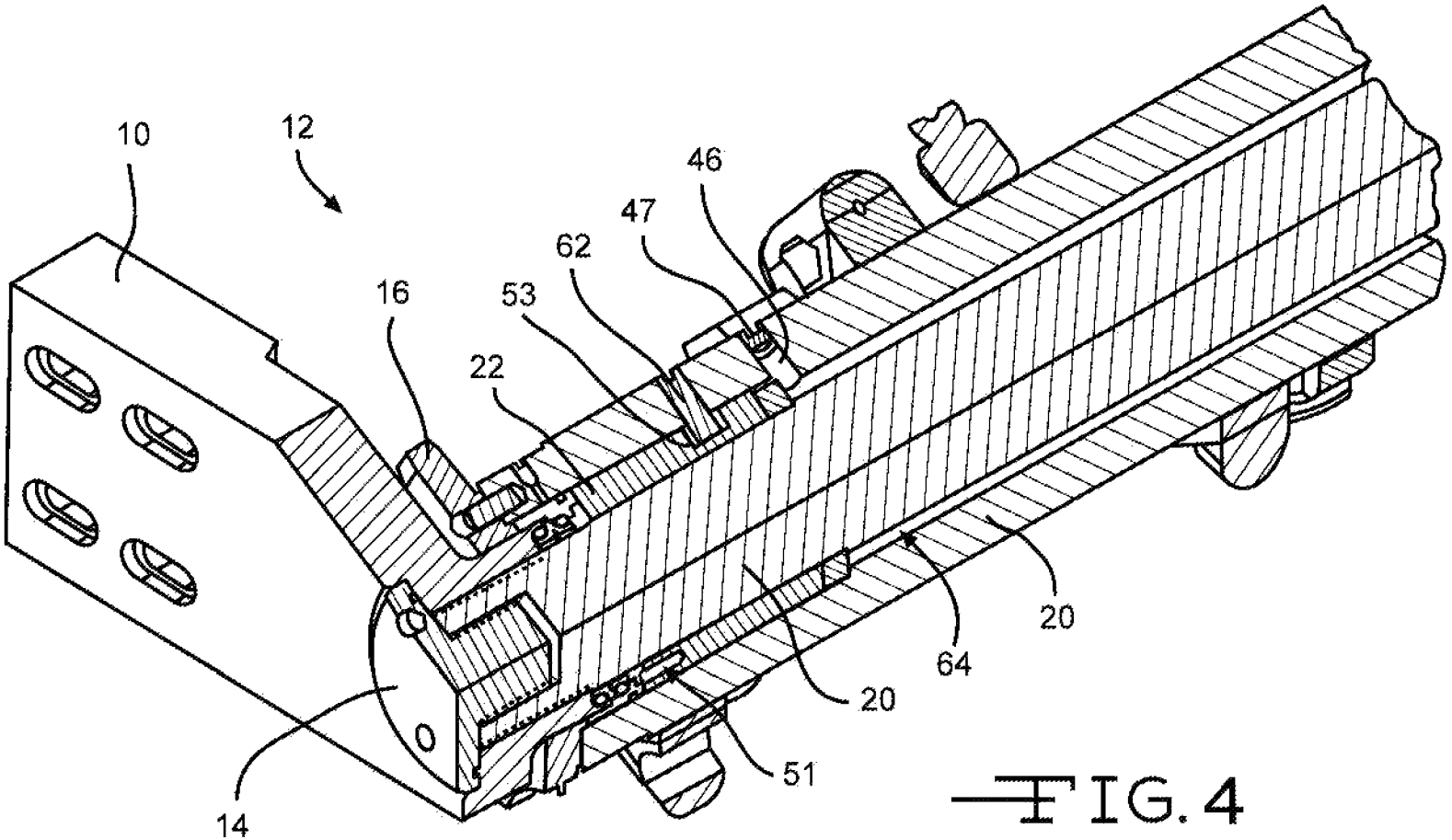
FIG. 4 is a detailed perspective section view of the frame and the rotary cutter of FIG. 1 having two sections taken.

Two bearing hubs 22 are used in the rotary cutter 12. One bearing hub 22 is disposed on each end 40 of the shaft 20. For ease of description, only one bearing hub 22 and end 40 will be described as both ends 40 are substantially similar. The bearing hub 22 is cylindrical in shape and is hollow. The bearing hub 22 is of a robust thick wall design to provide roundness backup tolerances which may be useful when the bearing is coated. In the illustrated embodiment an interior portion 41 of the bearing hub 22 and a shoulder of the bearing hub 22 are laser hardened. The bearing hub 22 is sized and configured to be disposed in an interior portion of the cutter drum 24. Threads 51 (illustrated in FIG. 4) are disposed on openings of the bearing hub 22, the threads 51 serving to assist in removal of the bearing hub 22 from the cutter drum 24. An indentation 53 is disposed on an exterior of the bearing hub 22. The bearing hub 22 may be configured so that rotation of the bearing hub 22 with respect to the cutter drum 24 is inhibited. In an alternative embodiment the bearing hub 22 may be configured such that the bearing hub 22 may rotate with respect to the cutter drum 24.

Figure 6:
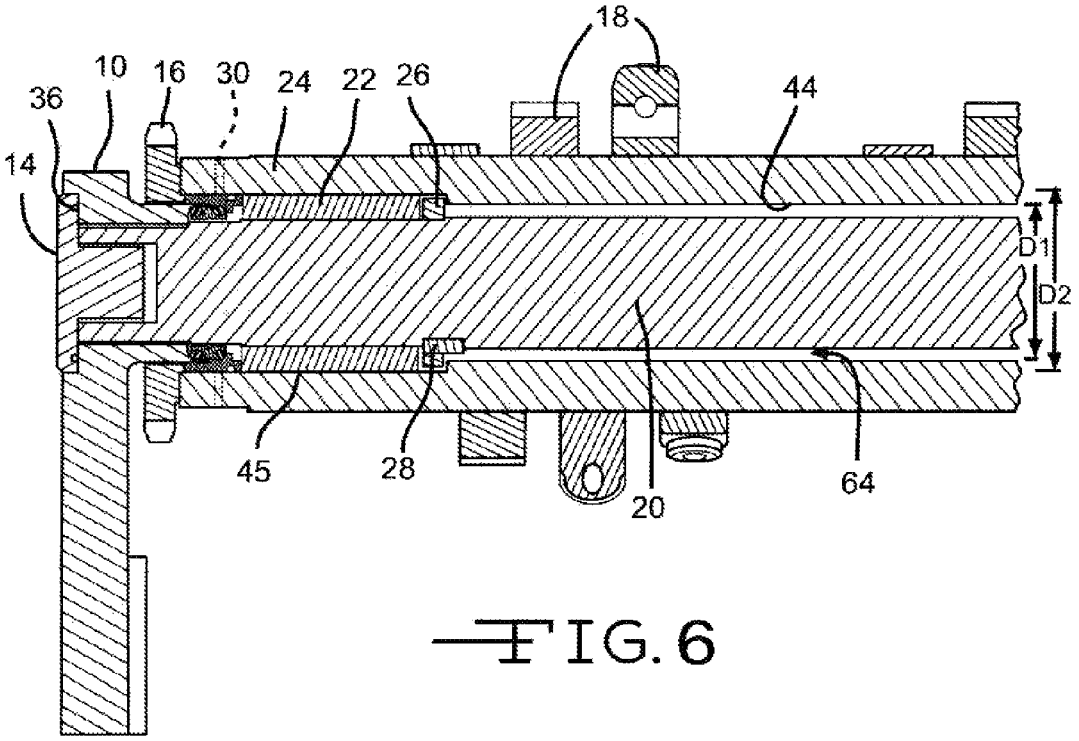
FIG. 6 is a detailed top section view of the frame and the rotary cutter of FIG. 1.

The cutter drum 24 is substantially cylindrical and is hollow. As best seen in FIG. 6, a center interior portion 44 of the cutter drum 24 has a first diameter D1 while an end interior portion 45 of the cutter drum 24 has a second diameter D2. In the illustrated embodiment D2 is greater than D1 which inhibits certain components (e.g. the bearing hub 22) from passing towards the center interior portion 44 of the cutter drum 24. Although only one end of the cutter drum 24 is illustrated in FIG. 6, the other end of the cutter drum 24 is substantially similar and thus will not be described herein. Pick bits 18 are coupled to the cutter drum 24 using bolts, welding, or the like. One or more oil fill passages 46 (best seen in FIG. 4) are disposed on the cutter drum 24 to allow a fluid, such as oil or another lubricant, to enter or be removed from the interior of the cutter drum 24 when the rotary cutter 12 is fully assembled. Plug assemblies 47 may be placed in the oil fill passages 46 to inhibit fluids from leaving the interior of the cutter drum 24 and/or to inhibit foreign materials from entering the interior portion of the cutter drum 24. A plurality of bolt holes 48 are disposed on the ends 40 of the cutter drum 24 to assist in coupling the sprockets 16 to the cutter drum 24. Bolts, nails, screws or the like are used to couple the sprockets 16 to the cutter drum 24. In an alternative embodiment the sprockets 16 may be welded to the cutter drum 24 or may be integral to the cutter drum 24.

Two inner bearings 26 and two keys 28 are used in the rotary cutter 12. One inner bearing 26 and key 28 is disposed on each end 40 of the shaft 20. For ease of description, only one inner bearing 26 and key 28 will be described as both ends of the rotary cutter 12 are substantially similar. The inner bearing 26 is substantially in the shape of a ring and is coupled to the shaft 20 using the key 28 such that the key 28 inhibits the inner bearing 26 from rotating with respect to the shaft 20, but does not inhibit the inner bearing 26 from moving longitudinally along an axis of the shaft 20. In an alternative embodiment more than one key 28 is used to couple the inner bearing 26 to the shaft 20. The inner bearing 26 is sized and configured such that it is inhibited from entering the center interior portion 44 of the cutter drum 24. In the illustrated embodiment the inner bearing 26 is a thrust (shouldered) style bearing, the inner bearing 26 interfacing with the bearing hub 22 which is a sleeve (journal) style bearing. In an alternative embodiment the inner bearing 26 may be an axial or thrust or common ball roller or tapered roller bearing. The inner bearing 26 in the illustrated disclosure is coated with a molybronze coating.

Figure 5:
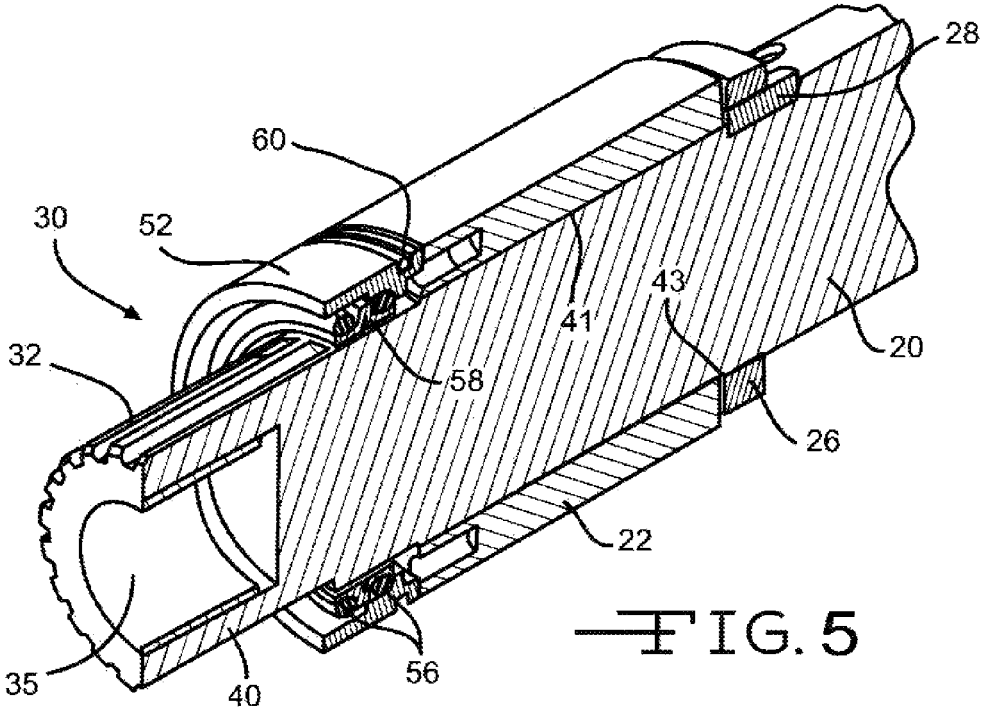
FIG. 5 is a perspective section view of a seal assembly, shaft, bearing hub and inner bearings of the rotary cutter of FIG. 1.

The seal assembly 30 (best seen in FIG. 5) includes a duo-cone seal retainer ring 52, two resilient toric elements 56, a metal to metal seal 58 and a resilient member 60. In the illustrated embodiment the metal to metal seal 58 is a duo-cone metal to metal seal. An interior portion of the duo-cone seal retainer ring 52 includes a series of steps which are sized and configured to interface with the metal to metal seal 58. The resilient member 60 rests in a groove disposed on an exterior circumference of the duo-cone seal retainer ring 52. The metal to metal seal 58 is disposed between the shaft 20 and the duo-cone seal retainer ring 52. The metal to metal seal 58 includes a raised portion and two shoulders, all running along an outer circumference of the metal to metal seal 58. One resilient toric element 56 rests on each shoulder of the metal to metal seal 58.

The assembly of the rotary cutter 12 will now be described. Each end of the rotary cutter 12 is a minor image of the other end, so only the assembly of a single end will be described. First, one or more keys 28 and the inner bearing 26 are placed onto the shaft 20, the key 28 serving to inhibit the inner bearing 26 from rotating with respect to the shaft 20. At this point the shaft 20 may be inserted into the cutter drum 24 and then one or more keys 28 and the inner bearing 26 are placed onto the opposite side of shaft 20. Next the bearing hub 22 and seal assembly 30 may be assembled to the shaft 20, while the bearing hub 22 and seal assembly 30 are simultaneously inserted into the opposite side of the cutter drum 24. A bolt 62 can then be inserted through an opening on the cutter drum 24 into the indentation 53 in order to align the bearing hub 22 and allow floating movement to follow shim tolerances with the cutter drum 24 and duo-cone seal retainer ring 52. The bolt 62 also inhibits the cutter drum 24 from rotating with respect to the bearing hub 22. Next the duo-cone seal retainer ring 52, including the resilient member 60, is placed on the shaft 20 and into cutter drum 24. After that the toric elements 56 and metal to metal seal 58 are placed onto the shaft 20, the toric elements 56 and metal to metal seal 58 being placed between the shaft 20 and the duo-cone seal retainer ring 52. In the next step the sprocket 16 is coupled to the cutter drum 24 using screws, bolts, dowel pins or the like. Next the frame 10 is placed onto the splines 32 of the shaft 20. A seal 36 is placed between the frame 10 and the end cap 14. The end cap 14 is then inserted into the hollow portion 35 of the shaft 20 and the end cap 14 is coupled to the frame 10 using screws, bolts, tack-welds or the like. Other embodiments may be assembled in a similar, or different, fashion.

When fully assembled, the rotary cutter 12 includes an oil reservoir 64 (best seen in FIG. 6) disposed between the cutter drum 24 and the shaft 20, and the two inner bearings 26. The oil reservoir 64 may be evacuated or filled by removing the plug assembly 47 and inserting or removing oil or some fluid through the oil fill passage 46. When the rotary cutter 12 is in use, the plug assembly 47 inhibits the oil or fluid from leaving the oil reservoir 64. In addition, the inner bearings 26 inhibit the oil or fluid from leaving the oil reservoir 64. However, the passageways 42 allow an amount of oil or fluid to leave the oil reservoir 64 and assist in lubricating the interface between the shaft 20 and the bearing hub 22. The seal assembly 30 inhibits oil or fluid from leaving an interior of the cutter drum 24. The seal assembly 30 also inhibits dirt or other foreign matter from entering an interior of the cutter drum 24.

Industrial Applicability

The rotary cutter 12 and frame 10 have industrial applicability on tunnel boring machines, continuous mining machines and other mining machines where they can be used to crush and remove rock for mining or other purposes. The rotary cutter is one of the most important wear items on a continuous mining machine, and constitutes an important limiting factor of a mining machine's excavation speed and efficiency. The rotary cutter 12 disclosed herein lasts longer and requires less maintenance than prior art rotary cutters, resulting in a faster and more efficient rotary cutter.

The rotary cutter 12 uses sleeve (journal) and shouldered (thrust) bearings, as has been described herein, instead of tapered roller bearings as have been used in the past on rotary cutters. The sleeve bearing system is much more compact than the tapered roller bearing. The use of a sleeve bearing system permits the shaft 20 and the cutter drum 24 to occupy a proportionally larger portion of the total annular space or volume of the rotary cutter 12. The resulting larger cutter drum 24 may permit the rotary cutter 12 to last longer in operation, minimizing the amount of maintenance needed, and increasing the overall efficiency or excavation speed of the rotary cutter 12. Substituting sleeve bearings for tapered roller bearings is also useful in assembly as the tapered roller bearings typically require precise operations during assembly to preload. The sleeve bearing does not require steps to preload. The use of the bearing hub 22 in combination with the inner bearing 26 allows for the shaft 20 to float with respect to the bearing hub 22 and inner bearing 26, which does not result in damage to the rotary cutter 12 when the shaft 20 and/or cutter drum 24 expand or contract axially due to temperature changes. The seal assembly 30 also allows for axial tolerance gaps that may result from such thermal changes.

The shaft 20, cutter drum 24 and/or other components may flex during operation of the rotary cutter 12, resulting in a pressure differential between the two sides of the seal assembly 30. If the pressure differential rises too high, oil can squirt past the seal assembly 30, or foreign materials may be drawn past the seal assembly 30 from outside of the rotary cutter 12. To help prevent this possibility, shaft 20 includes passageways 42 which help oil move from one side of the rotary cutter 12 to the other, opposite side to relieve oil pressure differentials.

Lubricating oil or fluid is sent from the oil reservoir 64 via passageways 42 to lubricate bearing areas such as the bearing hub 22, the inner bearing 26 and the seal assembly 30. Lubricating oil or fluid stored in the oil reservoir 64 serves to reduce the temperature of the lube oil near bearing surfaces during rotary cutter 12 operation which in turn helps maintain the temperature of the seal assembly 30, bearing hub 22 and inner bearing 26 below maximum levels. In addition, lubricating oil or fluid stored in the oil reservoir 64 serves to dampen vibrations that occur during operation of the rotary cutter 12.

It will be apparent to those skilled in the art that various modifications and variations can be made to the disclosed rotary cutter drum apparatus. Other embodiments will be apparent to those skilled in the art from consideration of the specification and practice of the disclosed rotary cutter drum apparatus. It is intended that the specification and examples be considered as exemplary only, with a true scope being indicated by the following claims and their equivalents.

What is claimed is:

1. A rotary cutter comprising:

a cutter drum having a bore;

a bit coupled to an exterior surface of the cutter drum;

a shaft positioned inside the bore, the shaft having a flat passageway extending along a longitudinal axis of the shaft and a bearing portion disposed on an exterior surface of the shaft;

a bearing disposed between the shaft and the cutter drum; and an inner bearing disposed on the shaft between the bearing and a center portion of the shaft, wherein the inner bearing is configured to interface with the bearing and is inhibited from rotating with respect to the shaft, and wherein the inner bearing and the bearing are configured to move longitudinally along an axis of the shaft.

2. The rotary cutter of claim 1 wherein the cutter drum rotates with respect to the shaft.

3. The rotary cutter of claim 2 wherein the cutter drum has a first inner portion having a first inner diameter and a second inner portion having a second inner diameter, the second inner diameter being larger than the first inner diameter, wherein the bearing and the inner bearing are positioned within the second inner portion, and wherein the inner bearing is sized to inhibit the bearing and the inner bearing from entering the first inner portion.

4. The rotary cutter of claim 3 further comprising an oil reservoir for storing oil or another lubricating fluid, the oil reservoir being disposed between the cutter drum and the shaft.

5. The rotary cutter of claim 4 further comprising a duo-cone seal disposed on the shaft, wherein the inner bearing is configured to inhibit lubricating fluid from leaving the oil reservoir other than via the passageway, and wherein the duo-cone seal is configured to inhibit the lubricating fluid from leaving the bore.

6. A rotary cutter comprising:

a cutter drum having a first bore comprising:

a first inner portion having a first diameter; and a second inner portion having a second diameter wherein the second diameter is greater than the first diameter;

a cutting bit coupled to the cutter drum;

a bearing having a second bore, the bearing disposed in the first bore;

a shaft positioned inside the second bore, the shaft having a flat passageway extending along an axis of the shaft and a bearing portion disposed on an exterior surface of the shaft, the bearing portion being in contact with the bearing;

an oil reservoir disposed in the first inner portion between the cutter drum and the shaft, the oil reservoir being filled with a lubricating fluid, wherein the lubricating fluid passes along the passageway from the oil reservoir to a surface where the bearing portion of the shaft contacts the bearing; and an inner bearing disposed in the first bore on the shaft between the bearing and a center portion of the shaft, wherein the inner bearing is configured to interface with the bearing and is inhibited from rotating with respect to the shaft, wherein the inner bearing and the bearing are configured to move longitudinally along an axis of the shaft, and wherein the inner bearing is configured to inhibit the lubricating fluid from leaving the oil reservoir other than via the passageway.

7. The rotary cutter of claim 6 wherein the center portion of the shaft has a third diameter and an end portion of the shaft has a fourth diameter, the third diameter being greater than the fourth diameter.

8. The rotary cutter of claim 6 further comprising a duo-cone seal disposed on the shaft, the duo-cone seal configured to inhibit oil or another lubricating fluid from leaving the first bore.

9. The rotary cutter of claim 6 wherein splines are disposed on the shaft, the splines being configured to couple the shaft to a frame.

10. The rotary cutter of claim 9 further comprising a sprocket coupled to the cutter drum.

11. The rotary cutter of claim 6 further comprising an oil fill passage disposed on the cutter drum, the oil fill passage being configured to allow a lubricating fluid to enter or leave the oil reservoir.

12. The rotary cutter of claim 6 wherein the bearing is disposed in the second inner portion of the cutter drum.

13. The rotary cutter of claim 12 wherein the inner bearing is coupled to the shaft with a key, the inner bearing being disposed in the second inner portion of the cutter drum and being sized to inhibit the bearing and the inner bearing from entering the first inner portion.

14. A mining machine comprising:

a frame;

a shaft coupled to the frame, the shaft having a flat passageway extending along an axis of the shaft and a bearing portion disposed on an exterior surface of the shaft;

a bearing disposed on the shaft, a portion of the bearing being in contact with the bearing portion of the shaft;

a cutter drum disposed on the bearing, the cutter drum rotating with respect to the shaft;

a cutting bit coupled to the cutter drum; and an inner bearing disposed on the shaft between the bearing and a center portion of the shaft, wherein the inner bearing is configured to interface with the bearing and is inhibited from rotating with respect to the shaft, and wherein the inner bearing and the bearing are configured to move longitudinally along the axis of the shaft.

15. The mining machine of claim 14 wherein the cutter drum has a first inner portion having a first diameter and a second inner portion having a second diameter wherein the second diameter is greater than the first diameter, and the bearing is disposed in the second inner portion.

16. The mining machine of claim 5 further comprising a lubricating fluid disposed in an oil reservoir, the oil reservoir being disposed in the first inner portion.

17. The mining machine of claim 14 wherein the flat passageway is disposed at a 7 O'clock position on the shaft relative to a second flat passageway extending along the axis of the shaft and disposed at an 11 O'clock position on the shaft.

18. The mining machine of claim 17 wherein the flat passageway is at least one of laser hardened and induction hardened.

* * * * *

UNITED STATES PATENT AND TRADEMARK OFFICE

CERTIFICATE OF CORRECTION

PATENT NO. : 8,939,516 B2
APPLICATION NO. : 13/717817
DATED : January 27, 2015
INVENTOR(S) : Myers et al.

It is certified that error appears in the above-identified patent and that said Letters Patent is hereby corrected as shown below:

In the specification

Column 4, line 58, delete "minor" and insert -- mirror --.

Column 5, line 37, delete "Industrial Applicability" and insert -- INDUSTRIAL APPLICABILITY --.

Signed and Sealed this
Twenty-ninth Day of December, 2015

Michelle K. Lee

Michelle K. Lee
*Director of the United States Patent and Trademark Office*